US011673771B2

(12) United States Patent
Koskinen et al.

(10) Patent No.: US 11,673,771 B2
(45) Date of Patent: Jun. 13, 2023

(54) ELEVATOR CAR PARKING BRAKE

(71) Applicant: Kone Corporation, Helsinki (FI)

(72) Inventors: Antti Koskinen, Helsinki (FI); Hilkka Hamalainen, Helsinki (FI); Timo Vlasov, Helsinki (FI); Mikko Puranen, Helsinki (FI); Antti Saarelainen, Helsinki (FI); Henri Wenlin, Helsinki (FI)

(73) Assignee: Kone Corporation, Helsinki (FI)

( * ) Notice: Subject to any disclaimer, the term of this patent is extended or adjusted under 35 U.S.C. 154(b) by 403 days.

(21) Appl. No.: 16/729,753

(22) Filed: Dec. 30, 2019

(65) Prior Publication Data

US 2020/0207582 A1 Jul. 2, 2020

(30) Foreign Application Priority Data

Dec. 31, 2018 (EP) ..... 18215984

(51) Int. Cl.
*B66B 5/20* (2006.01)
*B66B 5/00* (2006.01)
*B66B 17/34* (2006.01)

(52) U.S. Cl.
CPC ..... *B66B 5/20* (2013.01); *B66B 5/0025* (2013.01); *B66B 17/34* (2013.01)

(58) Field of Classification Search
CPC .. B66B 5/20; B66B 5/18; B66B 17/34; B66B 11/0293; B66B 5/22
See application file for complete search history.

(56) References Cited

U.S. PATENT DOCUMENTS 8,517,150 B2 8/2013 Grundmann et al.
9,511,977 B2 * 12/2016 Schautt ..... B66B 5/24
2015/0217970 A1 8/2015 Schautt

FOREIGN PATENT DOCUMENTS

CN 102085989 A 6/2011
CN 103754720 A 4/2014
CN 105358462 A 2/2016
CN 205132807 U 4/2016
(Continued)

OTHER PUBLICATIONS

Machine Translation of WO 2019/185569.*
(Continued)

*Primary Examiner* — Diem M Tran
(74) *Attorney, Agent, or Firm* — Harness, Dickey & Pierce, P.L.C.

(57) ABSTRACT

According to an aspect, there is provided an elevator car parking brake comprising brake pads and an actuator configured to move the brake pads with respect to a guide rail. The elevator car parking brake further comprises levers, each having an associated brake pad; and at least one screw associated with the actuator and rotatably fixed to at least one lever via at least one attaching member. In a braking operation, the actuator is configured to rotate the at least one screw in a first direction with respect to the at least one attaching member, thus causing the levers with the brake pads to move towards the guide rail. In a brake release operation, the actuator is configured to rotate the at least one screw in a second direction with respect to the at least one attaching member, thus causing the levers with the brake pads to move away from the guide rail.

7 Claims, 3 Drawing Sheets

(56) References Cited

FOREIGN PATENT DOCUMENTS

| | | | | | |
|---|---|---|---|---|---|
| CN | 107628497 | A | | 1/2018 | |
| CN | 207792393 | U | | 8/2018 | |
| CN | 112320535 | A | * | 2/2021 | ..... B66B 11/0226 |
| EP | 2338821 | A1 | | 6/2011 | |
| JP | 2003182945 | A | | 7/2003 | |
| JP | 2009046246 | A | | 3/2009 | |
| JP | 2009215039 | A | | 9/2009 | |
| JP | 2012041157 | A | | 3/2012 | |
| WO | WO-2012110273 | A1 | | 8/2012 | |
| WO | WO-2014154306 | A1 | | 10/2014 | |
| WO | WO-2019185569 | A1 | * | 10/2019 | ..... B66B 17/34 |

OTHER PUBLICATIONS

European Search Report: Reference No. P-EP114253F; Application No./Patent No. 18215984.8-1017; dated Aug. 7, 2019.
English translation of Chinese Office Action dated Oct. 25, 2022 (corresponding to CN201911390438.4).

* cited by examiner

ELEVATOR CAR PARKING BRAKE

CROSS-REFERENCE TO RELATED APPLICATION

This application claims priority to European Patent Application No. EP18215984.8 filed on Dec. 31, 2018, the entire contents of which are incorporated herein by reference.

BACKGROUND

An elevator car needs to be kept within a door zone at a landing so that a car door sill and a landing door sill are on the same level for safe boarding and exit of passengers. Due to elasticity of hoisting ropes, a load change in the elevator car and the resulting tension change in the hoisting ropes will move the car and create a step between the car and landing posing a tripping hazard. Relevelling of the car by machinery is a known method for preventing such a tripping hazard. However, precision positioning of the car is a complex task and the dynamic load change during loading and unloading of the car will most likely make the process iterative.

A parking brake solves the problem that is due the suspension elasticity during loading and unloading. The parking brake holds the elevator car in its place during loading and unloading and releases its grip after the load has been transferred to the suspension ropes and the car and landing doors have been closed, before the elevator starts to run again.

As the parking brakes are engaged at every landing stop of the elevator car, they need to be reliable and endure long-term use. Therefore, there is a need for an elevator car parking brake solution that would provide a simple but efficient elevator car parking brake.

SUMMARY

According to a first aspect, there is provided an elevator car parking brake comprising brake pads and an actuator configured to move the brake pads with respect to a guide rail. The elevator car parking brake further comprises levers, each having an associated brake pad; at least one screw associated with the actuator and rotatably fixed to at least one lever via at least one attaching member. In a braking operation, the actuator is configured to rotate the at least one screw in a first direction with respect to the at least one attaching member, thus causing the levers with the brake pads to move towards the guide rail. In a brake release operation, the actuator is configured to rotate the at least one screw in a second direction with respect to the at least one attaching member, thus causing the levers with the brake pads to move away from the guide rail.

In an embodiment, the levers are pivoted such that the force produced by the actuator is multiplied for the brake pads.

In an embodiment, the at least one screw comprises one screw rotatably fixed to a first lever via the attaching member, and the actuator is fixed to a second lever.

In an embodiment, the at least one screw comprises two screws, a first screw being rotatably fixed to a first lever via a first attaching member and a second screw being rotatably fixed to a second lever via a second attaching member.

In an embodiment, the actuator comprises an electro-mechanical actuator, and further comprising a controller configured to calculate revolutions of the electro-mechanical actuator when the electro-mechanical actuator is operated to move the brake pads in the braking operation; and determine wearing of the brake pads based on the calculated revolutions.

In an embodiment, the controller is configured to issue a wearing alert when the number of revolutions exceeds a predefined threshold value.

According to a second aspect, there is provided an elevator car comprising at least one elevator car parking brake of the first aspect.

BRIEF DESCRIPTION OF THE DRAWINGS

The accompanying drawings, which are included to provide a further understanding of the invention and constitute a part of this specification, illustrate embodiments of the invention and together with the description help to explain the principles of the invention. In the drawings.

DETAILED DESCRIPTION

Figure 1A:
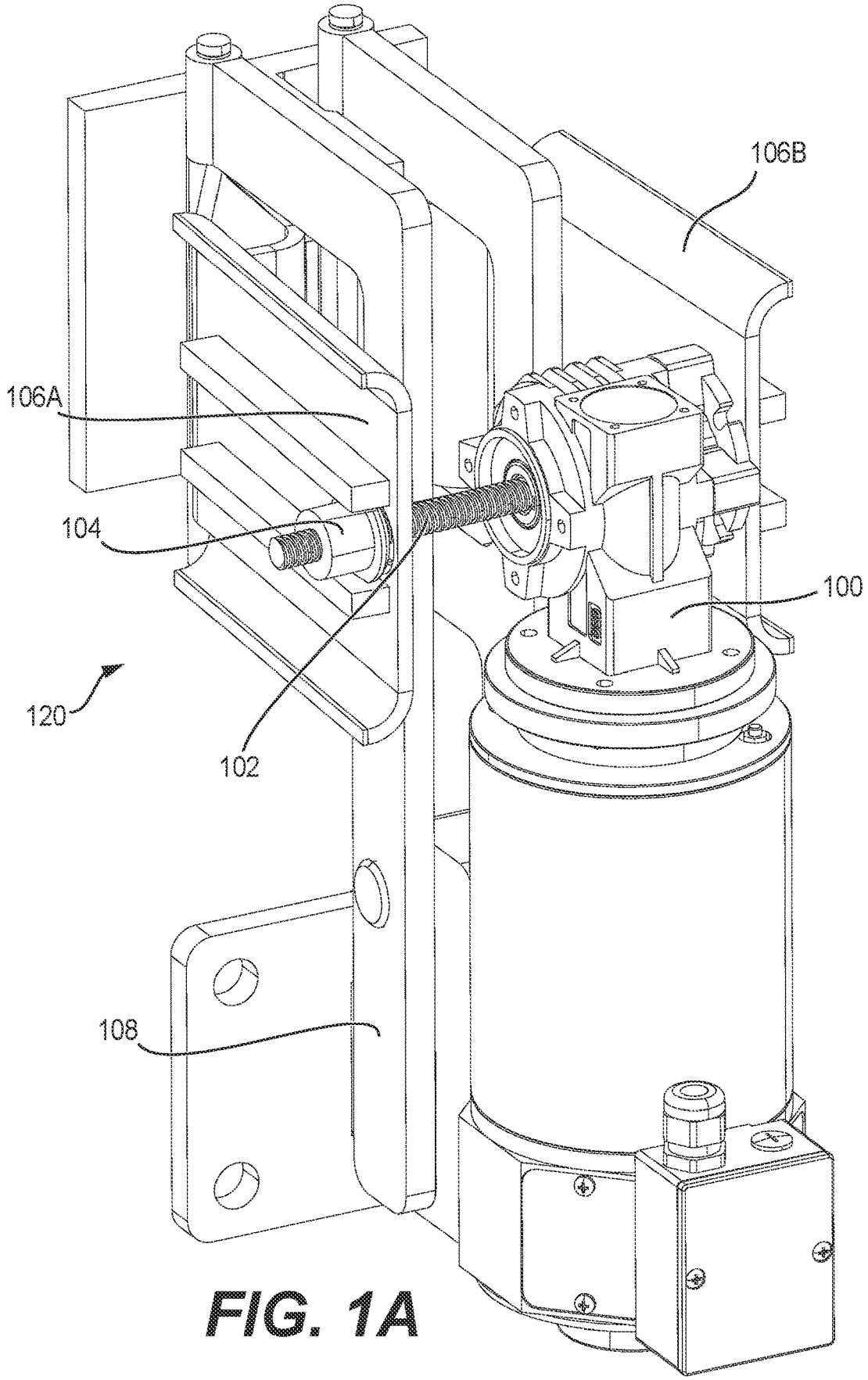
FIG. 1A illustrates an elevator car parking brake according to an embodiment.
Figure 1B:
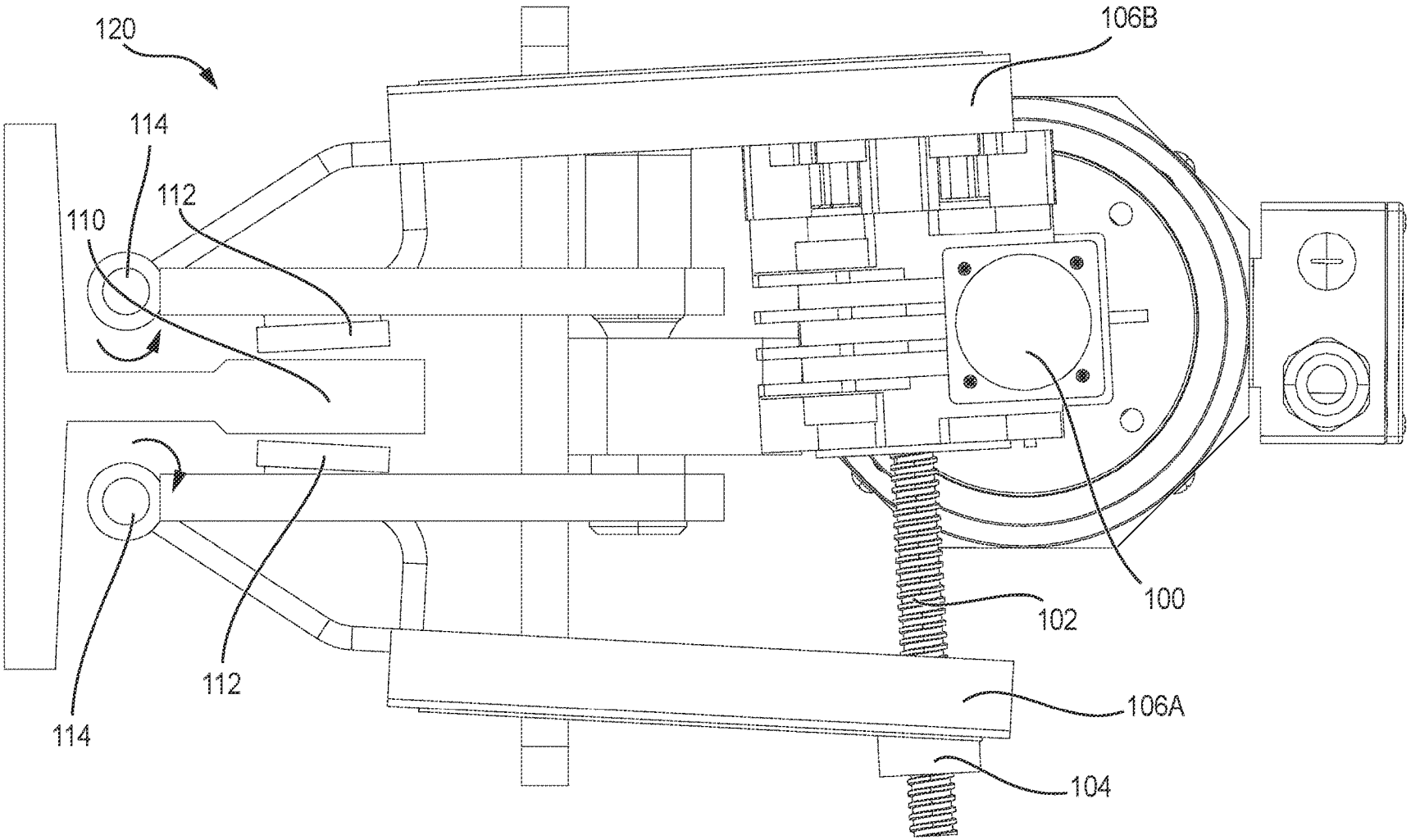
FIG. 1B illustrates another view of the elevator car parking brake of FIG. 1A.

FIG. 1A illustrates an elevator car parking brake 120 according to an embodiment. FIG. 1B illustrates another view of the elevator car parking brake of FIG. 1A. An elevator car parking brake holds an elevator in its place during loading and unloading and releases its grip after the load has been transferred to suspension ropes and car and landing doors have been closed, before the elevator starts to run again.

The elevator car parking brake 120 comprises an actuator 100 configured to move brake pads 112 with respect to a guide rail 110. The elevator car parking brake 120 further comprises levers 106A, 106B, each having an associated brake pad 112. When the levers 106A, 106B move, also the brake pads 112 move. The elevator car parking brake 120 further comprises a screw 102 associated with the actuator 100 and rotatably fixed to a first lever 106A via an attaching member 104. On the other side the actuator 100 is fixed to a second lever 106B. An inner thread of the attaching member 104 corresponds with an outer thread of the screw 102 so that the screw 102 is able to rotate through the attaching member 104. The actuator 100 is movably fixed to a brake carrier 108 or sling to allow movement of the screw end of the actuator 100 in the axial direction of the screw 102.

In a braking operation, the actuator 100 is configured to rotate the screw 102 in a first direction with respect to the attaching member 104, thus causing the levers 106A, 106B with the brake pads 112 to move towards the guide rail 110. The forces resulting from a load change in the elevator car are transmitted to the guide rail 110 by the levers 106A, 106B with the brake pads 112 operatively connected to the brake carrier 108. In a brake release operation, the actuator 100 is configured to rotate the screw 102 in a second direction opposite to the first direction with respect to the attaching member 104, thus causing the levers 106A, 106B with the brake pads 112 to move away from the guide rail 110.

In other words, the elevator car parking brake 120 works so that the actuator 100 turns the screw 102 that moves the levers 106A, 106B towards each other and thus compresses the guide rail 110 between the brake pads 112. The levers 106A, 106B may be fixed onto hinges 114 that are fixed on the brake carrier 108. In other embodiments, other pivoting points may be used to achieve an equal leverage effect. In an embodiment, the levers 106A, 106B may be pivoted such that the force produced by the actuator 100 is multiplied for the brake pads 112. The brake carrier 108 may be fixed on a sling. A lever ratio can be decided such that the brake closing speed and force is appropriate for the elevator. On the hinges 108 there may be returning springs that push the levers 106A, 106B back in the released state of the elevator car parking brake 120. In one embodiment, the elevator car parking brake 120 may be located on top of the sling, and the actuator 100 and a gear between top beams.

An advantage of the above illustrated solution is that less torque is required from the actuator and the gear because the lever ratio increases the force at the brake pads. In addition, the actuator and gear can be located between the two sling top beams where there is more space and the brake will not affect other components so much.

Figure 1C:
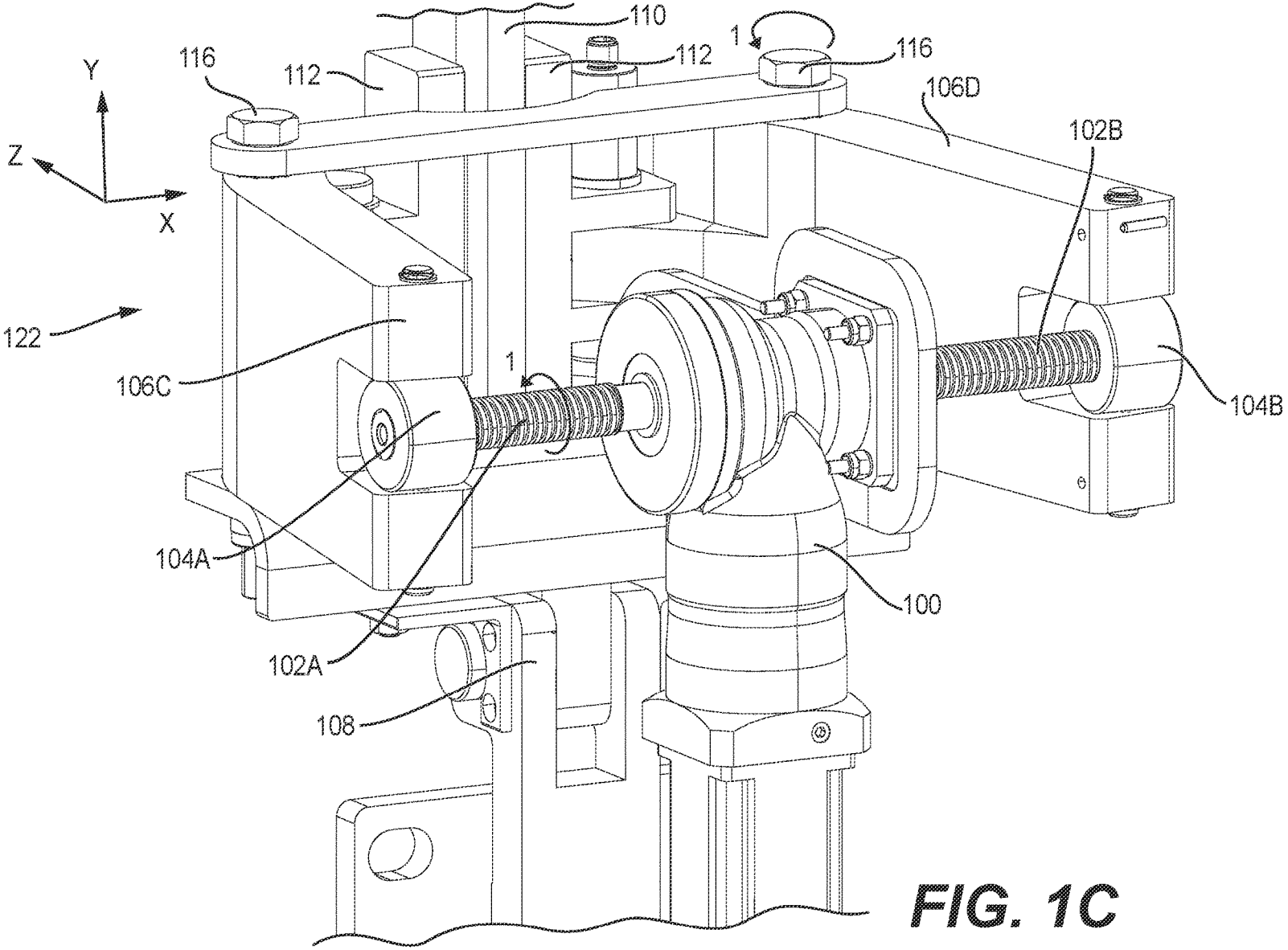
FIG. 1C illustrates an elevator car parking brake according to another embodiment.

FIG. 1C illustrates an elevator car parking brake 122 according to another embodiment.

The elevator car parking brake 122 comprises an actuator 100 configured to move brake pads 112 with respect to a guide rail 110. The elevator car parking brake 122 further comprises levers 106C, 106D, each having an associated brake pad 112. When the levers 106C, 106D move, also the brake pads 112 move. The elevator car parking brake 122 further comprises two screws 102A, 102B. The first screw 102A is rotatably fixed to a first lever 106C via a first attaching member 104A and a second screw 102B is rotatably fixed to a second lever 106D via a second attaching member 104B. An inner thread of the attaching members 104A, 104B corresponds with an outer thread of the screws 102A, 102B so that the screws 102A, 102B are able to rotate through the attaching members 104A, 104B.

In a braking operation, the actuator 100 is configured to rotate the screws 102A, 102B in a first direction with respect to the members 104A, 104B, thus causing the levers 106C, 106D with the brake pads 112 to move towards the guide rail 110. The forces resulting from a load change in the elevator car are transmitted to the guide rail 110 by the levers 106C, 106D with the brake pads 112 operatively connected to the brake carrier 108. In a brake release operation, the actuator 100 is configured to rotate the screws 102A, 102B in a second direction with respect to the attaching members 104A, 104B, thus causing the levers 106C, 106D with the brake pads 112 to move away from the guide rail 110.

In other words, the elevator car parking brake 122 operates in such way that there are levers 106C, 106D symmetrically on both sides of a tip of the guide rail 110. The guide rail 110 is compressed between the two brake pads 112 that are fixed on the levers 106C, 106D. The levers 106C, 106D may be fixed on a sling by the brake carrier 108. The actuator 100 and gear may also be fixed on the brake carrier 108 and the actuator 100 is allowed to move in the z-direction. The screws 102A, 102B may be right and left handed trapezoidal screws fixed on the gear. When the actuator 100 rotates the screws 102A, 102B on direction 1, the levers 106C, 106D turn around hinges 116 to direction 1, and the brake pads 112 grip the guide rail 110. The gripping to the guide rail 110 happens during elevator door opening while the elevator car is stationary. When the screws 102A, 102B are rotated on the other direction, the brake pads 112 are detached from the guide rail 110. In one embodiment, the brake pads 112 need to move away from the guide rail 110 a minimum distance, for example, 5 mm when the elevator car is moving. Detaching of the brakes is done after the loading or unloading and before elevator is ready to start.

An advantage of the above illustrated solution is that it enables to locate the actuator and gear between sling upper beams where they have appropriate space. Further, a roller guide bracket gives a good cover for brakes. Further, the motor braking force can be amplified with the lever ratio which allows the usage of a smaller actuator compared, for example, to caliper brakes where the actuator is located directly on the guide rail.

In any of the embodiments illustrated in FIGS. 1A-1C, the actuator 100 may comprise an electro-mechanical actuator. The elevator car parking brake 120, 122 may further comprise a controller configured to calculate revolutions of the electro-mechanical actuator motor, for example by an encoder, when the electro-mechanical actuator is operated to move the brake pads 112 in the braking operation, and to determine wearing of the brake pads 112 based on the calculated revolutions. When the brake pads 112 wear out, they need to be moved a longer distance towards side surfaces of the guide rail 110 in order to achieve a proper braking state. This means that the electric motor has to be operated longer (i.e. the number of revolutions performed by the electric motor increases) in order to achieve a proper braking state. The controller may also be configured to issue a wearing alert when the number of revolutions exceeds a predefined threshold value. This may also mean that the brake pads 112 may need to be replaced with new ones.

When implementing determination of rotated full rounds and an angle inside one round of the electro-mechanical actuator, a very low-cost solution for elevator car brake pad wearing can be implemented. The disclosed solution also enables remote detection of brake pad wearing.

Further, although FIGS. 1A-1C may illustrate that the actuator 100 is a rotary actuator, in other embodiments, other actuator types may also be used, for example, with one or more adapter components.

While there have been shown and described and pointed out fundamental novel features as applied to preferred embodiments thereof, it will be understood that various omissions and substitutions and changes in the form and details of the devices and methods described may be made by those skilled in the art without departing from the spirit of the disclosure. Moreover, it should be recognized that structures and/or elements and/or method steps shown and/or described in connection with any disclosed form or embodiments may be incorporated in any other disclosed or described or suggested form or embodiment as a general matter of design choice.

The applicant hereby discloses in isolation each individual feature described herein and any combination of two or more such features, to the extent that such features or combinations are capable of being carried out based on the present specification as a whole, in the light of the common general knowledge of a person skilled in the art, irrespective of whether such features or combinations of features solve any problems disclosed herein, and without limitation to the scope of the claims. The applicant indicates that the disclosed aspects/embodiments may consist of any such individual feature or combination of features. In view of the foregoing description it will be evident to a person skilled in the art that various modifications may be made within the scope of the disclosure.

The invention claimed is:

1. An elevator car parking brake comprising:

a pair of brake pads; and an actuator configured to move the pair of brake pads with respect to a guide rail;

wherein the elevator car parking brake further comprises:

a pair of levers, each of the pair of levers having an associated one of the pair of brake pad, the pair of levers each being connected to a respective one of a pair of hinges each on opposite lateral sides of the guide rail;

at least one screw associated with the actuator and rotatably fixed to at least one of the pair of levers via at least one attaching member;

wherein, in a braking operation, the actuator is configured to rotate the at least one screw in a first direction with respect to the at least one attaching member, thus causing the pair of levers with the respective one of the pair of brake pads to move towards the guide rail; and wherein, in a brake release operation, the actuator is configured to rotate the at least one screw in a second direction with respect to the at least one attaching member, thus causing the pair of levers with the respective one of the pair of brake pads to move away from the guide rail, wherein the actuator comprises an electro-mechanical actuator, and further comprising a controller configured to:

calculate revolutions of the electro-mechanical actuator when the electro-mechanical actuator is operated to move the pair of brake pads in the braking operation; and determine wearing of the pair of brake pads based on the calculated revolutions.

2. An elevator car parking brake comprising:

a pair of brake pads; and an actuator configured to move the pair of brake pads with respect to a guide rail;

wherein the elevator car parking brake further comprises:

a pair of levers, each of the pair of levers having an associated one of the pair of brake pad, the pair of levers each being connected to a respective one of a pair of hinges each on opposite lateral sides of the guide rail;

at least one screw associated with the actuator and rotatably fixed to at least one of the pair of levers via at least one attaching member;

wherein, in a braking operation, the actuator is configured to rotate the at least one screw in a first direction with respect to the at least one attaching member, thus causing the pair of levers with the respective one of the pair of brake pads to move towards the guide rail;

wherein, in a brake release operation, the actuator is configured to rotate the at least one screw in a second direction with respect to the at least one attaching member, thus causing the pair of levers with the respective one of the pair of brake pads to move away from the guide rail, wherein the pair of levers are pivoted such that the force produced by the actuator is multiplied for the brake pads.

3. The elevator car parking brake of claim 1, wherein the at least one screw comprises one screw rotatably fixed to a first lever of the pair of levers via the attaching member, and the actuator is fixed to a second lever of the pair of levers.

4. The elevator car parking brake of claim 1, wherein the controller is configured to issue a wearing alert when the number of revolutions exceeds a predefined threshold value.

5. An elevator car comprising at least one elevator car parking brake of claim 1.

6. An elevator car parking brake comprising:

a pair of brake pads; and an actuator configured to move the pair of brake pads with respect to a guide rail;

wherein the elevator car parking brake further comprises:

a pair of levers, each of the pair of levers having an associated one of the pair of brake pad, the pair of levers each being connected to a respective one of a pair of hinges each on opposite lateral sides of the guide rail;

at least one screw associated with the actuator and rotatably fixed to at least one of the pair of levers via at least one attaching member;

wherein, in a braking operation, the actuator is configured to rotate the at least one screw in a first direction with respect to the at least one attaching member, thus causing the pair of levers with the respective one of the pair of brake pads to move towards the guide rail; and wherein, in a brake release operation, the actuator is configured to rotate the at least one screw in a second direction with respect to the at least one attaching member, thus causing the pair of levers with the respective one of the pair of brake pads to move away from the guide rail, wherein the at least one screw comprises two screws, a first screw being rotatably fixed to a first lever of the pair of levers via a first attaching member and a second screw being rotatably fixed to a second lever of the pair of levers via a second attaching member.

7. An elevator car parking brake comprising:

a pair of brake pads; and an actuator configured to move the pair of brake pads with respect to a guide rail;

wherein the elevator car parking brake further comprises:

a pair of levers, each of the pair of levers having an associated one of the pair of brake pad, the pair of levers each being connected to a respective one of a pair of hinges each on opposite lateral sides of the guide rail;

at least one screw associated with the actuator and rotatably fixed to at least one of the pair of levers via at least one attaching member;

wherein, in a braking operation, the actuator is configured to rotate the at least one screw in a first direction with respect to the at least one attaching member, thus causing the pair of levers with the respective one of the pair of brake pads to move towards the guide rail; and wherein, in a brake release operation, the actuator is configured to rotate the at least one screw in a second direction with respect to the at least one attaching member, thus causing the pair of levers with the respective one of the pair of brake pads to move away from the guide rail, wherein the pair of brake pads are located at an intermediate position on a respective one of the pair of levers between a respective one of the pair of hinges at a first end of a respective one of the pair of levers and the actuator which engages a second end of the pair of levers.

* * * * *